US010267461B2

(12) United States Patent
Wegh et al.

(10) Patent No.: US 10,267,461 B2
(45) Date of Patent: Apr. 23, 2019

(54) LIGHTING MODULE AND LIGHTING DEVICE COMPRISING THE LIGHTING MODULE

(71) Applicant: PHILIPS LIGHTING HOLDING B.V., Eindhoven (NL)

(72) Inventors: René Theodorus Wegh, Eindhoven (NL); Martijn Jochem Van Uden, Eindhoven (NL); Ties Van Bommel, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 27 days.

(21) Appl. No.: 15/549,913

(22) PCT Filed: Feb. 11, 2016

(86) PCT No.: PCT/EP2016/052900
§ 371 (c)(1),
(2) Date: Aug. 9, 2017

(87) PCT Pub. No.: WO2016/128509
PCT Pub. Date: Aug. 18, 2016

(65) Prior Publication Data

US 2018/0031183 A1 Feb. 1, 2018

(30) Foreign Application Priority Data

Feb. 12, 2015 (EP) ..... 15154784

(51) Int. Cl.
*F21K 9/238* (2016.01)
*F21K 9/237* (2016.01)
(Continued)

(52) U.S. Cl.
CPC ..... *F21K 9/237* (2016.08); *F21K 9/232* (2016.08); *F21K 9/238* (2016.08); *F21S 4/10* (2016.01);
(Continued)

(58) Field of Classification Search
CPC . F21K 9/20; F21K 9/232; F21K 9/235; F21K 9/237; F21K 9/238; F21K 9/60;
(Continued)

(56) References Cited

U.S. PATENT DOCUMENTS 6,409,361 B1 * 6/2002 Ikeda ..... F21V 19/0025 362/240
6,771,866 B2 * 8/2004 Iimura ..... G02B 6/02 385/12
(Continued)

FOREIGN PATENT DOCUMENTS

CN 203215314 U 9/2013
CN 203231145 U 10/2013
(Continued)

*Primary Examiner* — Hargobind S Sawhney
(74) *Attorney, Agent, or Firm* — Akarsh P. Belagodu

(57) ABSTRACT

A lighting module (100) is disclosed, comprising a light-transmissive, elongated member (110) with a light-guiding region (114) within the elongated member (110). The elongated member (110) may be configured such that the light-guiding region (114) permits passage of fluid through the elongated member (110), possibly between a first end (116) and a second end (118) thereof. A plurality of light-emitting elements (170) are coupled to the elongated member (110) within the elongated member (110) and such that the optical axis of at least one light-emitting element is non-perpendicular with respect to a longitudinal axis (LA) of the lighting module (100). A lighting device (200) comprising the lighting module (100) is also disclosed.

14 Claims, 5 Drawing Sheets

(51) Int. Cl.

| | |
|---|---|
| ***F21V 3/00*** | (2015.01) |
| ***F21V 19/00*** | (2006.01) |
| ***F21V 29/83*** | (2015.01) |
| ***F21K 9/232*** | (2016.01) |
| ***F21V 29/503*** | (2015.01) |
| ***F21V 29/56*** | (2015.01) |
| ***F21S 4/10*** | (2016.01) |
| *F21V 29/506* | (2015.01) |
| *F21Y 115/10* | (2016.01) |
| *F21Y 107/10* | (2016.01) |

(52) U.S. Cl.
CPC ..... *F21V 3/00* (2013.01); *F21V 19/0015* (2013.01); *F21V 29/503* (2015.01); *F21V 29/56* (2015.01); *F21V 29/83* (2015.01); *F21V 29/506* (2015.01); *F21Y 2107/10* (2016.08); *F21Y 2115/10* (2016.08)

(58) Field of Classification Search
CPC ... F21K 9/61; F21K 9/23; F21V 13/04; F21V 23/006; F21V 29/02; F21V 29/20; F21V 29/503; F21V 29/508; F21V 5/002; F21V 19/0015; F21V 29/004; F21V 29/506; F21V 29/56; F21V 29/70; F21V 3/02; G02B 6/0053; F21S 4/20; F21S 4/28; F21Y 2103/10; F21Y 2107/10; F21Y 2107/20
See application file for complete search history.

(56) References Cited

U.S. PATENT DOCUMENTS

| | | | | |
|---|---|---|---|---|
| 7,712,918 | B2 * | 5/2010 | Siemiet | F21S 4/28 362/241 |
| 8,757,839 | B2 | 6/2014 | Hussell et al. | |
| 8,761,565 | B1 | 6/2014 | Coleman et al. | |
| 8,866,368 | B2 * | 10/2014 | Yu | F21K 9/00 313/36 |
| 9,010,964 | B2 * | 4/2015 | Wang | F21V 7/04 362/241 |
| 2010/0090245 | A1 * | 4/2010 | Lin | H01L 33/483 257/100 |
| 2011/0101842 | A1 | 5/2011 | Valenzano | |
| 2012/0273809 | A1 * | 11/2012 | Tsai | H01L 25/0753 257/88 |
| 2013/0070457 | A1 | 3/2013 | Nishiuchi et al. | |
| 2013/0170175 | A1 | 7/2013 | Negley et al. | |
| 2013/0028664 | A1 | 10/2013 | Wang | |
| 2014/0268771 | A1 | 9/2014 | Heikman | |
| 2014/0375202 | A1 * | 12/2014 | Yang | F21V 29/004 313/36 |
| 2015/0003039 | A1 * | 1/2015 | Liu | F21K 9/00 362/84 |
| 2015/0155441 | A1 * | 6/2015 | Alexeev | H01L 33/387 257/99 |

FOREIGN PATENT DOCUMENTS

| | | | | |
|---|---|---|---|---|
| JP | 2007234470 | A | 9/2007 | |
| WO | WO 2014191251 | A1 * | 12/2014 | F21V 3/00 |
| WO | WO2015007738 | A1 | 1/2015 | |

* cited by examiner

LIGHTING MODULE AND LIGHTING DEVICE COMPRISING THE LIGHTING MODULE

CROSS-REFERENCE TO PRIOR APPLICATIONS

This application is the U.S. National Phase application under 35 U.S.C. § 371 of International Application No. PCT/EP2016/052900, filed on Feb. 11, 2016, which claims the benefit of European Patent Application No. 15154784.1, filed on Feb. 12, 2015. These applications are hereby incorporated by reference herein.

TECHNICAL FIELD

The present invention generally relates to the field of lighting equipment and devices. Specifically, the present invention relates to a lighting module having a light-transmissive, elongated member and a plurality of light-emitting elements coupled to the elongated member within the elongated member.

BACKGROUND

The use of light-emitting diodes (LEDs) for illumination purposes continues to attract attention. Compared to incandescent lamps, fluorescent lamps, neon tube lamps, etc., LEDs provide numerous advantages such as a longer operational life, reduced power consumption, an increased efficiency related to the ratio between light energy and heat energy, etc. Solid state based light sources such as LED based light sources may have different optical characteristics compared to incandescent light sources. In particular, solid state based light sources may provide a more directed light distribution and a higher (i.e. cooler) color temperature compared to incandescent light sources. Therefore, efforts have been made in order to make solid state based lighting devices mimic or resemble traditional incandescent lighting devices, e.g. with respect to light distribution and/or color temperature. In bulb lighting devices based on LEDs, commonly referred to as "retrofit lamps" since these LED lamps are often designed to have the appearance of a traditional incandescent light bulb and to be mounted in conventional sockets, etc., the light emitting filament wire is replaced with one or more LEDs. The atmosphere within the bulb is generally air. However, cooling of the LEDs may pose a problem in LED based retrofit lamps. Overheating of LEDs can lead to reduced lifetime, decreased light output or failure of the LEDs.

SUMMARY

In one lighting device architecture for realizing a LED bulb or retrofit lamp, the LEDs are mounted onto the outside of a tubular carrier with open ends, which tubular carrier is arranged within a bulb for example made of glass or ceramic. Such a tubular carrier may generally be referred to as an elongated hollow structure having one or more open ends, which structure for example may be cylindrical, conical, truncated conical, funnel-shaped, etc., and may for example have a circular, triangular, rectangular, etc., cross-section. The tubular carrier provides functionality similar to that of a chimney, allowing a fluid (or gas) flow through the tubular carrier, thereby facilitating cooling of the tubular carrier and the LEDs by way of convection taking place within the chimney (i.e. heat generated by the LEDs is transferred to fluid within the tubular carrier, thereby creating a convection flow of fluid within and through the tubular carrier). Although such a chimney configuration or architecture may provide a relatively high efficiency of heat transport away from the LEDs, it may not be able to realize a uniform light intensity distribution from the LED bulb or retrofit lamp which resembles a traditional incandescent light bulb. For example, a LED bulb or retrofit lamp based on such a chimney configuration or architecture may exhibit a region on the outer surface of the bulb corresponding to a relatively low intensity of light. Such a 'dark' region may be visible to a viewer, which may be undesired. If the bulb of a LED bulb or retrofit lamp based on such a chimney configuration or architecture for some reason would be broken while still being connected to a lamp or luminaire socket, it may be inconvenient or even dangerous to remove the LED bulb or retrofit lamp from the lamp or luminaire socket. This is due to that the person removing the LED bulb or retrofit lamp from the lamp or luminaire socket may during the removal touch electrical contacts on the outside of the tubular carrier.

In view of the above, a concern of the present invention is to provide a lighting module or lighting device which facilitates or allows for achieving a more uniform distribution of intensity of light emitted by the lighting module or lighting device as compared to utilizing a chimney configuration or architecture as described in the foregoing.

A further concern of the present invention is to provide a lighting module or lighting device which facilitates or allows for achieving an efficiency of heat transport away from light-emitting elements in the lighting module or lighting device comparable to that of a chimney configuration or architecture as described in the foregoing or even higher.

A further concern of the present invention is to provide a lighting module or lighting device which facilitates or allows for reducing or even eliminating risk of inconvenience or danger for a user when handling a broken lighting module or lighting device.

To address at least one of these concerns and other concerns, a lighting module in accordance with the independent claim is provided. Preferred embodiments are defined by the dependent claims.

According to a first aspect, there is provided a lighting module which comprises a light-transmissive, elongated member having an inner surface which at least in part defines, or delimits, a light-guiding region within the elongated member. The lighting module comprises a plurality of light-emitting elements. Each light-emitting element is configured to emit light. The plurality of light-emitting elements are coupled to the elongated member within the elongated member, and such that the optical axis of at least one light-emitting element is non-perpendicular with respect to a longitudinal axis of the lighting module.

The elongated member may have at least a first end. The elongated member may be configured such that the light-guiding region permits passage of fluid therethrough, and possibly into and out of the first end. The elongated member may further have a second end, and be configured such that the light-guiding region permits passage of fluid into and out of the second end. The elongated member may possibly have more than two ends, and be configured such that the light-guiding region permits passage of fluid into and out of each of the respective ends. According to one or more embodiments of the present invention, the elongated member may be closed, and possibly sealed, so as to not permit flow or passage of fluid into and out of the elongated member or light-guiding region.

By the elongated member being configured such that the light-guiding region within the elongated member permits passage of fluid therethrough, and into and out of the first end and possibly e.g. the second end, flow of circulation of fluid, e.g. a gas such as air or helium, through the light-guiding region, and hence through the elongated member, is facilitated or enabled. Thus, the elongated member may provide functionality similar to that of a chimney, facilitating or allowing for heat transport by way of convection to take place within the elongated member. Thereby, a relatively high degree of cooling of the light-emitting elements, which are coupled to the elongated member within the elongated member, may be achieved.

As will be discussed further in the following, a lighting module according to the first aspect may be included in a lighting device comprising a light-transmissive envelope at least in part enclosing the lighting module. The light-transmissive envelope may at least in part define a fluidly sealed and enclosed space within which the lighting module is arranged, and which space may include or be filled with a thermally conductive fluid, for example a gas such as air or a gas including helium and/or hydrogen. The lighting device may for example be included in or constitute a LED bulb or retrofit lamp which is connectable to a lamp or luminaire socket by way of some appropriate connector, for example an Edison screw base, a bayonet fitting, or another type of connection suitable for the lamp or luminaire known in the art.

Since the light-emitting elements are coupled to the elongated member within the elongated member, there may be no need for electrical connections or contacts (e.g., arranged on or in a printed circuit board, PCB) on the outside of the elongated member. If the light-transmissive envelope would be broken while the lighting device is connected to a lamp or luminaire socket, a user may therefore be able to remove the lighting device from the lamp or luminaire socket by appropriate handling of the elongated member without having to risk directly touching the electrical connections or contacts.

By the plurality of light-emitting elements being coupled to the elongated member within the elongated member, such that the optical axis of at least one light-emitting element is non-perpendicular with respect to a longitudinal axis of the lighting module, it may be facilitated or enabled to provide a relatively high uniformity in light emission, e.g., with respect to light intensity and/or brightness, substantially all around the lighting module. That is, it may be facilitated or enabled to achieve a lighting module capable of emitting light in a relatively large number of directions from the lighting module, or even so as to achieve a substantially omnidirectional light emission from the lighting module.

By way of appropriate configuration of the elongated member so as to achieve a selected shape of the inner surface of the elongated member, there may be achieved that the optical axis of at least one light-emitting element is non-perpendicular with respect to a longitudinal axis of the lighting module. At least a portion of at least the inner surface of the elongated member may for example be non-parallel with respect to the longitudinal axis of the lighting module or the elongated member. For example, the at least a portion of at least the inner surface of the elongated member may curve outwards or inwards at least longitudinally. At least some light-emitting elements may be coupled to and/or supported by the at least a portion of the inner surface.

In alternative or in addition, the elongated member may be arranged such that it is curved with respect to longitudinal axis of the lighting module.

In general, in order to realize or implement that the optical axis of at least one light-emitting element is non-perpendicular with respect to a longitudinal axis of the lighting module, the at least one light-emitting element may for example be coupled to the inner surface of the elongated member, and the inner surface may be arranged in relation to the longitudinal axis of the lighting module such that the optical axis of the at least one light-emitting element is non-perpendicular with respect to the longitudinal axis of the lighting module. In alternative or in addition, the at least one light-emitting element may be coupled to the inner surface of the elongated member, possibly using some appropriate coupling means, in such a way that the main direction of light emission from the light-emitting element (which may define the optical axis of the light-emitting element) is non-perpendicular with respect to the longitudinal axis of the lighting module.

As mentioned above, the optical axis of at least one light-emitting element is non-perpendicular with respect to the longitudinal axis of the elongated member, or the lighting module. There may be more than one light-emitting element whose optical axis is non-perpendicular with respect to the longitudinal axis of the elongated member, or the lighting module, i.e. whose optical axis is at an angle with respect to the longitudinal axis different from 90 degrees or approximately 90 degrees. There may be several ones of the light-emitting elements whose optical axes are non-perpendicular with respect to the longitudinal axis of the elongated member or the lighting module, and possibly such that their optical axes are at different angles to the longitudinal axis with respect to each other, so as to facilitate or enable achieving a lighting module capable of emitting light in a relatively large number of directions from the lighting module.

According to one or more embodiments of the present invention, the plurality of light-emitting elements may be coupled to the elongated member within the elongated member such that optical axes of at least two light-emitting elements are at different angles with respect to a longitudinal axis of the lighting module.

According to an example, the elongated member may be hollow. The light-guiding region, or cavity, may for example include or be constituted by open void(s), which may permit any fluid or gas such as air to pass through or within the elongated member.

According to another example, the light-guiding region may include or be constituted by one or more materials which permit passage of fluid through the light-guiding region and at the same time permits propagation or conveyance of light therein, for example along a direction in which the light-guiding region extends. The material may at least in part include a transparent material, allowing light to pass through the material without being scattered. The material may for example include a porous material, i.e. a material containing pores, or voids The light-transmissive material of the elongated member may be transparent or translucent. The elongated member may include at least one portion that is transparent, or it may include at least one portion that is translucent, or it may include at least one portion that is transparent and at least one portion that is translucent. Thus, by the elongated member being "light-transmissive" it is not necessarily meant that the entire or substantially the entire elongated member is light-transmissive; only a portion or portions of the elongated member may be light-transmissive, while other portions may not be light-transmissive.

The plurality of light-emitting elements being coupled to the elongated member within the elongated member may entail that each light-emitting element is configured or arranged so as to emit light from a position within the elongated member.

One or more or even all of the plurality of light-emitting elements may be directly coupled or connected to the elongated member, e.g. to the inner surface of the elongated member. One or more or even all of the plurality of light-emitting elements may be indirectly coupled or connected to the elongated member, e.g. to the inner surface of the elongated member, via one or more intermediate components. One or some of the plurality of light-emitting elements may be directly coupled or connected to the elongated member, and one or some of the plurality of light-emitting elements may be indirectly coupled or connected to the elongated member.

According to an example in accordance with one or more embodiments of the present invention, the inner surface of the elongated member may comprise at least one recess, or cavity, or cut-out. The recess may for example comprise a groove or a groove-like structure. At least one of the light-emitting elements may be arranged in the recess or cavity or cut-out.

According to another example, at least some of the plurality of light-emitting elements may at least in part be enclosed in an enclosure. The enclosure may be connected to the inner surface of the elongated member. For example, the enclosure may comprise a light-transmissive tubular structure for accommodating at least one string of light-emitting elements, e.g. in the form of a so called LED strip and/or a LED filament.

According to yet another example, at least one of the plurality of light-emitting elements may be embedded or integrated in the elongated member.

According to an example in accordance with one or more embodiments of the present invention, the material of a region of the elongated member in which at least one of the plurality of light-emitting elements is embedded may have a refractive index different from a refractive index of the material of an adjacent region of the elongated member. Another way to describe this is that the elongated member may comprise several materials having different refractive indices, wherein at least one of the plurality of light-emitting elements is at least in part enclosed in a material having a refractive index different from a refractive index of an adjacent, different material. For example, at least one light-emitting element may be embedded in a transparent material such as silicone, and with the light-emitting element embedded in silicone surrounded by another transparent material such as glass. By way of such a construction, light emitted by the light-emitting element may be coupled into the elongated member at one location and coupled out of the elongated member at another location which may be (substantially) different from the location where light was coupled into the elongated member, which may entail an increased uniformity in light emission, e.g., with respect to light intensity and/or brightness, substantially all around the lighting module.

According to one or more embodiments of the present invention, the inner surface of the elongated member may comprise a plurality of electrically conductive tracks, to which the plurality of light-emitting elements may be electrically connected. Such electrically conductive tracks may for example be applied by printing, and may in principle comprise any electrically conductive material suitable for the way the electrically conductive tracks are applied to the inner surface of the elongated member.

According to one or more embodiments of the present invention, the elongated member may be conical or cylindrical. However, other shapes of the elongated member are possible.

In the context of the present application, by the elongated member being cylindrical it is meant that the elongated member is cylinder-like, i.e. having a shape or form at least in part resembling the shape or form of a cylinder, and not necessarily shaped as a perfect or ideal cylinder.

In the context of the present application, by the elongated member being conical it is meant that the elongated member is cone-like, i.e. having a shape or form at least in part resembling the shape or form of a cone, and not necessarily shaped as a perfect or ideal cone.

The elongated member may comprise at least one light-scattering element configured to scatter light incident on the at least one light-scattering element. For example, the at least one light-scattering element may comprise light-scattering particles embedded or integrated in the elongated member. In alternative or in addition, the at least one light-scattering element may comprise a layer or coating of material such as $Al_2O_3$, $BaSO_4$ and/or $TiO_2$ on an inner and/or outer surface of the elongated member, and/or an inner and/or outer surface of the elongated member may have a rough structure.

According to another example, the elongated member or the at least one light-scattering element may in addition or in alternative comprise luminescent material selected from one or more elements in the group of quantum confinement structures, lanthanide complexes, rare earth metal elements and phosphors.

According to one example, the inner surface of the elongated member may be configured to support the plurality of light-emitting elements. According to another example, the lighting module may comprise a carrier which is configured to support the plurality of light-emitting elements, or to which the plurality of light-emitting elements are coupled. The carrier may or may not be coupled or connected to the inner surface of the elongated member. The carrier may for example comprise at least one printed circuit board (PCB), and/or a foil. The carrier may be at least in part flexible (i.e. at least a portion or portions of the carrier may be flexible). For example, the carrier may include a flexible PCB and/or a flexible foil.

The carrier may be configured to transfer heat, generated by the at least one light-emitting element when in use, away from the at least one light-emitting element. Thus the carrier may be configured so as to exhibit a heat transferring capacity and/or functionality.

The light-transmissive, elongated member may be arranged within an additional, hollow light-transmissive elongated member such that there is a space between an inner surface of the additional elongated member and an outer surface of the other elongated member, wherein the plurality of light-emitting elements are arranged in the space between the elongated members.

In other words, there may be a first, inner light-transmissive, elongated member and a second, outer light-transmissive, elongated member, wherein the second light-transmissive, elongated member is hollow and the first light-transmissive, elongated member is arranged within the second light-transmissive, elongated member. There may be a space between the first, inner light-transmissive, elongated member and the second, outer light-transmissive, elongated member, and the plurality of light-emitting elements may be arranged in that space. Hence, the plurality of light-emitting elements may be 'integrated' between two light-transmissive, elongated members.

The light-transmissive material of the additional or second elongated member may be transparent or translucent, or may include at least one portion that is transparent and at least one portion that is translucent.

According to a second aspect, there is provided a lighting device comprising a lighting module according to the first aspect. The lighting device may comprise a light-transmissive envelope at least in part enclosing the lighting module. The light-transmissive envelope may at least in part define a fluidly sealed and enclosed space within which the lighting module is arranged, and which space may include or be filled with a thermally conductive fluid, for example a gas including helium and/or hydrogen. The lighting device may comprise a base for connection to a lamp socket. The base may include or be constituted by any suitable type of connector, for example an Edison screw base, a bayonet fitting, or another type of connection. The lighting device may comprise more than one lighting module according to the first aspect.

As known in the art, the lighting module and/or the lighting device may include circuitry capable of converting electricity from a power supply to electricity suitable to operate or drive the plurality of light-emitting elements. The circuitry may be capable of at least converting between Alternating Current and Direct Current and converting voltage into a suitable voltage for operating or driving the plurality of light-emitting elements.

It is to be understood that when in the foregoing reference was made to the longitudinal axis of the lighting module, it may in alternative or in addition have been referred to a longitudinal axis of the lighting device.

At least one of the plurality of light-emitting elements may for example include or be constituted by a solid state light emitter. Examples of solid state light emitters include LEDs, OLEDs, and laser diodes. Solid state light emitters are relatively cost efficient light sources since they in general are relatively inexpensive and have a relatively high optical efficiency and a relatively long lifetime. However, in the context of the present application, the term "light-emitting element" should be understood to mean substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore a light-emitting element can have monochromatic, quasi-monochromatic, polychromatic or broadband spectral emission characteristics. Examples of light-emitting elements include semiconductor, organic, or polymer/polymeric LEDs, violet LEDs, blue LEDs, optically pumped phosphor coated LEDs, optically pumped nano-crystal LEDs or any other similar devices as would be readily understood by a person skilled in the art. Furthermore, the term light-emitting element can, according to one or more embodiments of the present invention, mean a combination of the specific light-emitting element or light-emitting elements which emit the radiation in combination with a housing or package within which the specific light-emitting element or light-emitting elements are positioned or arranged. For example, the term light-emitting element can encompass a bare LED die arranged in a housing, which may be referred to as a LED package.

The plurality of light-emitting elements may for example be configured as at least one string of light-emitting elements. According to one example, the plurality of light-emitting elements may include or be constituted by a so called LED strip and/or a LED filament, where the plurality of light-emitting elements may be bare LED dies mounted on a substrate, possibly with the substrate with LED dies comprising a phosphor layer. The phosphor layer can cover the entire substrate, or part of the substrate, or only the LED dies. The substrate can be for example a metal, glass, sapphire and/or ceramic strip or plate.

According to one or more embodiments, at least two light-emitting elements of the plurality of light-emitting elements may be spaced from each other with respect to (a direction of) the longitudinal axis of the lighting module or elongated member. Another way to describe this is that at least two light-emitting elements may be arranged at different 'heights' in the lighting module or elongated member, with respect to the longitudinal axis of the lighting module or elongated member.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the invention will be described below with reference to the accompanying drawings.

Figure 1:
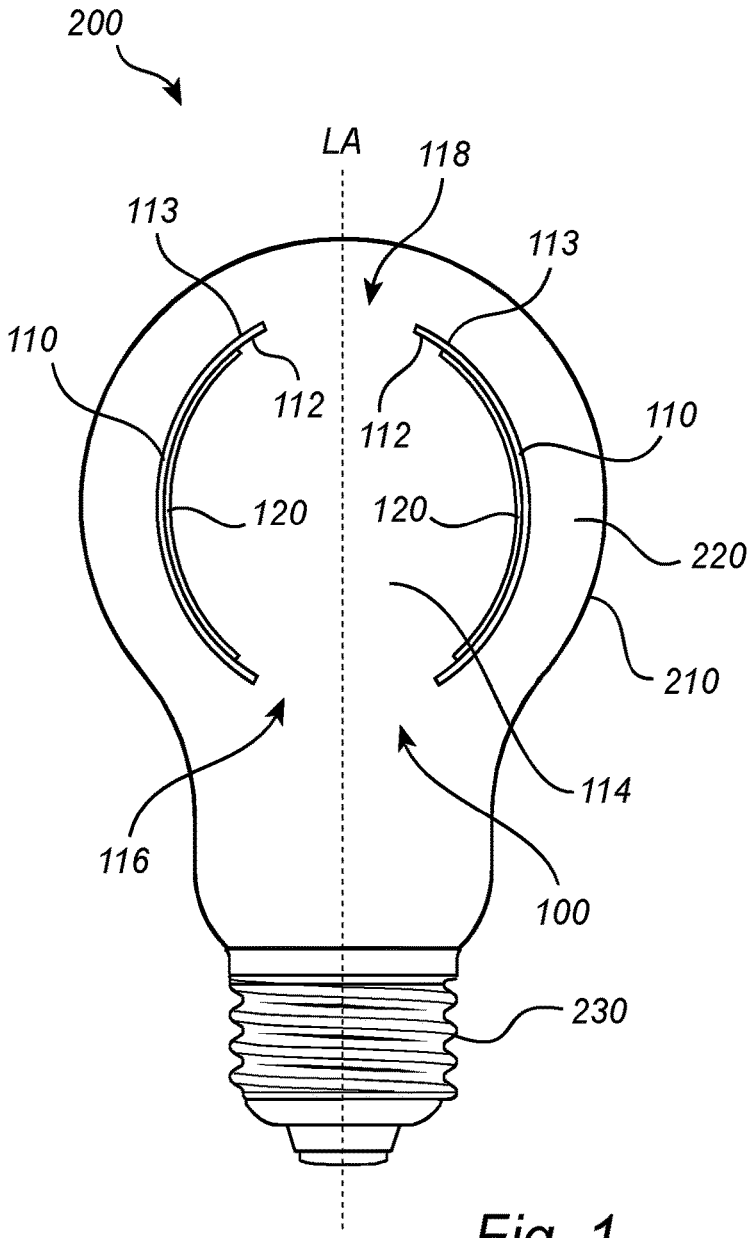
FIG. 1 is a schematic cross-sectional side view of a lighting device according to embodiments of the present invention.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments set forth herein; rather, these embodiments are provided by way of example so that this disclosure will convey the scope of the invention to those skilled in the art.

In the drawings, identical reference numerals denote the same or similar components having a same or similar function, unless specifically stated otherwise.

FIG. 1 is a schematic cross-sectional side view of a lighting device 200 according to embodiments of the present invention.

The lighting device 200 comprises a lighting module 100 and a light-transmissive envelope 210 which encloses the lighting module 100. In accordance with the embodiment of the present invention illustrated in FIG. 1, the light-transmissive envelope 210 is bulb-shaped. However, the bulb-shape of the light-transmissive envelope 210 depicted in FIG. 1 is according to an example. Other shapes of the light-transmissive envelope 210 are possible, and the light-transmissive envelope 210 may in principle have any shape.

The light-transmissive envelope 210 may at least in part define an enclosed space 220 within which the lighting module 100 is arranged. The light-transmissive envelope 210 may be configured such that the space 220 is a fluidly sealed space, and which space may include or be filled with air or a thermally conductive fluid, for example a gas including helium and/or hydrogen. The thermally conductive gas or fluid (e.g. including helium and/or hydrogen) may be combined with a certain content of e.g. oxygen.

In accordance with the embodiment of the present invention illustrated in FIG. 1, the lighting device 200 may comprise a base 230 for connection to a lamp or luminaire socket (not shown in FIG. 1). The base 230 may include or be constituted by any suitable type of coupler or connector, for example an Edison screw base, a bayonet fitting, or any other type of connection which may be suitable for the particular type of lamp or luminaire.

The lighting module 100 comprises a light-transmissive, elongated member 110 having an inner surface 112 which at least in part defines, or delimits, a light-guiding region 114 within the elongated member 110. The elongated member 110 has a first end 116 a second end 118. The elongated member 110 is configured such that the light-guiding region 114 permits passage of fluid through the light-guiding region 114, and into and out of the first end 116 and the second end 118, respectively. To that end, according to an example, the elongated member 110 may be hollow, such that the light-guiding region 114 or cavity includes or is constituted by an open void, as illustrated in FIG. 1, thereby permitting any fluid or gas such as air to pass through the elongated member 110. However, it is not necessary for the elongated member 110 to be hollow. According to another example (not shown in FIG. 1), the light-guiding region 114 may include or be constituted by a structure and/or one or more materials which permit passage of fluid through the light-guiding region 114 while at the same time permitting propagation or conveyance of light in the light-guiding region 114. The one or more materials of the light-guiding region 114 may at least in part include a transparent material, allowing light to pass through the material (substantially) without being scattered.

By the elongated member 110 being configured such that the light-guiding region 114 within the elongated member 110 permits passage of fluid through the elongated member 110 and into and out of the first end 116 and the second end 118, respectively, flow of circulation of fluid, e.g. a gas such as air or helium, through the light-guiding region 114, and hence through the elongated member 110, may be facilitated or even enabled. Thereby the elongated member 110 may provide functionality similar to that of a chimney, facilitating or allowing for heat transport by way of convection to take place within the elongated member 110 by a continuous circulation of fluid through the light-guiding region 114, and hence through the elongated member 110.

Although the elongated member 110 in accordance with the embodiment of the present invention illustrated in FIG. 1 has a first end 116 and a second end 118, into and out which passage of fluid can take place, it is to be understood that the elongated member 110 may have only one end (e.g., the first end 116) into and out of which passage of fluid can take place, or more than two ends into and out of which passage of fluid can take place, or may even be closed (and possibly sealed), so as to not permit flow or passage of fluid into and out of the elongated member 110 or the light-guiding region 114. A configuration of the elongated member 110 with a first end 116 and a second end 118 is also illustrated in FIGS. 2 to 7, which are described further in the following. However, it is to be understood that the elongated member 110 illustrated in any one of FIGS. 2 to 7 may in alternative have only one end into and out of which passage of fluid can take place, or more than two ends into and out of which passage of fluid can take place, or may be closed (and possibly sealed). Also, the elongated member 110 illustrated in any one of FIGS. 8 to 10 may have one or several ends into and out of which passage of fluid can take place, or it may be closed (and possibly sealed).

With further reference to FIG. 1, the lighting module 100 comprises a plurality of light-emitting elements, indicated in FIG. 1 by reference numeral 120. Each light-emitting element is configured to emit light. In accordance with the embodiment of the present invention illustrated in FIG. 1, the plurality of light-emitting elements 120 may be implemented as a series of light-emitting elements. The light-emitting elements may for example comprise LEDs, and the plurality of light-emitting elements 120 may for example be implemented as one or more LED strips or LED filaments.

The plurality of light-emitting elements 120 are coupled to the elongated member 110 within the elongated member 110. While in accordance with the embodiment of the present invention illustrated in FIG. 1 the plurality of light-emitting elements 120 are coupled to the elongated member 110, within the elongated member 110, by being connected to the inner surface 112 of the elongated member 110, e.g. by means of using transparent silicon glue, this is according to an example. In view of the foregoing description and the following description referring to the other FIGS. 2-10, it is clear to a skilled person that a direct connection of the plurality of light-emitting elements 120 to the inner surface 112 of the elongated member 110 is according to a non-limiting example and that variations are possible. Further, it is to be understood that one or more or even all of the plurality of light-emitting elements 120 may be directly coupled or connected to the elongated member 110, e.g. to the inner surface 112 of the elongated member 110, or that one or more or even all of the plurality of light-emitting elements 120 may be indirectly coupled or connected to the elongated member 110, e.g. to the inner surface 112 of the elongated member 110, via one or more intermediate components (not shown in FIG. 1). Further, one or some of the plurality of light-emitting elements 120 may be directly coupled or connected to the elongated member 110, and one or some of the plurality of light-emitting elements 120 may be indirectly coupled or connected to the elongated member 110.

The plurality of light-emitting elements 120 are coupled to the elongated member 110 such that the optical axis of at least one light-emitting element is non-perpendicular with respect to a longitudinal axis LA of the lighting module 100.

According to the embodiment of the present invention illustrated in FIG. 1, the longitudinal axis LA of the lighting module 100 coincides with a longitudinal axis of the lighting device 200. Further according to the embodiment of the present invention illustrated in FIG. 1, the longitudinal axis LA may be an axis of rotational symmetry of the lighting module 100 and/or the lighting device 200.

By way of appropriate configuration of the elongated member 110 so as to achieve a selected shape of the inner surface 112 of the elongated member 110, there may be achieved that the optical axis of at least one light-emitting element is non-perpendicular with respect to the longitudinal axis LA of the lighting module 100. According to the embodiment of the present invention illustrated in FIG. 1, the inner surface 112 and an outer surface 113 of the elongated member 110, opposite to the inner surface 112 of the elongated member 110, curves outwards longitudinally (i.e. with respect to the longitudinal axis LA). The plurality of light-emitting elements 120 are supported by the inner surface 112 of the elongated member 110. Thus, according to the embodiment of the present invention illustrated in FIG. 1, the inner surface 112 is arranged in relation to the longitudinal axis LA of the lighting module 110 such that the optical axis of at least one light-emitting element is non-perpendicular with respect to the longitudinal axis LA of the lighting module 100. In alternative or in addition, in order to realize or implement that the optical axis of at least one light-emitting element is non-perpendicular with respect to the longitudinal axis LA of the lighting module 100, the at least one light-emitting element could be coupled to the inner surface 112 of the elongated member 110, possibly using some appropriate coupling means, in such a way that the main direction of light emission from the light-emitting element (which may define the optical axis of the light-emitting element) is non-perpendicular with respect to the longitudinal axis LA of the lighting module 100.

Although not shown in FIG. 1 (or in the other FIGS. 2-10), the lighting device 200 (or lighting module 100) may include some kind of support structure for supporting the lighting module 100 in the lighting device 200. Such a support structure may for example comprise a stem or the like connected to the base 230, which stem may extend for example along the longitudinal axis LA into the elongated member 110 via the first end 116, and which stem may have support rods or the like extending laterally from the stem within the elongated member 110 and being coupled to the inner surface 112 of the elongated member 110. However, such a support structure is not necessary. For example, the light-transmissive envelope 210 may be configured or shaped such that a portion of its inner surface could be used to support the lighting module 100 and possibly allow the lighting module 100 to be coupled or connected to the inner surface of the light-transmissive envelope 210. For example, the light-transmissive envelope 210 may be configured or shaped so that its inner surface exhibits protrusions which may support the lighting module 100 or to which the lighting module 100 could be coupled or connected.

As known in the art, the lighting device 200 may include circuitry capable of converting electricity from a power supply to electricity suitable to operate or drive the plurality of light-emitting elements 120 and/or power any other electrical components that may be included in the lighting device 200. Such circuitry, which is not shown in FIG. 1, may be capable of at least converting between Alternating Current and Direct Current and converting voltage into a suitable voltage for operating or driving the plurality of light-emitting elements 120.

FIGS. 2 to 7 are schematic cross-sectional side views of lighting modules 100 according to embodiments of the present invention.

Although the elongated members 110 of the lighting modules 100 illustrated in FIGS. 2 to 5 have a curved shape, such that the inner surface 112 and an outer surface 113 of the elongated member 110, opposite to the inner surface 112 of the elongated member 110, curves outwards longitudinally (i.e. with respect to the longitudinal axis LA (not shown in FIGS. 2 to 5)), it is to be understood that this is according to an example, and that other shapes of the elongated member 110 are possible.

Figure 2:
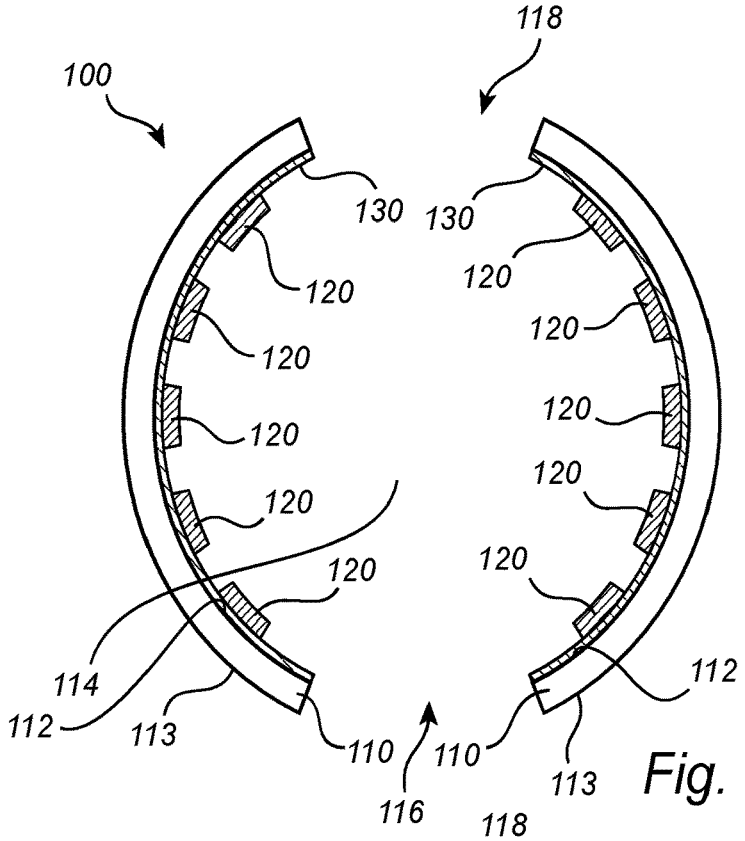
FIGS. 2 to 7 are schematic cross-sectional side views of lighting modules according to embodiments of the present invention.
Figure 3:
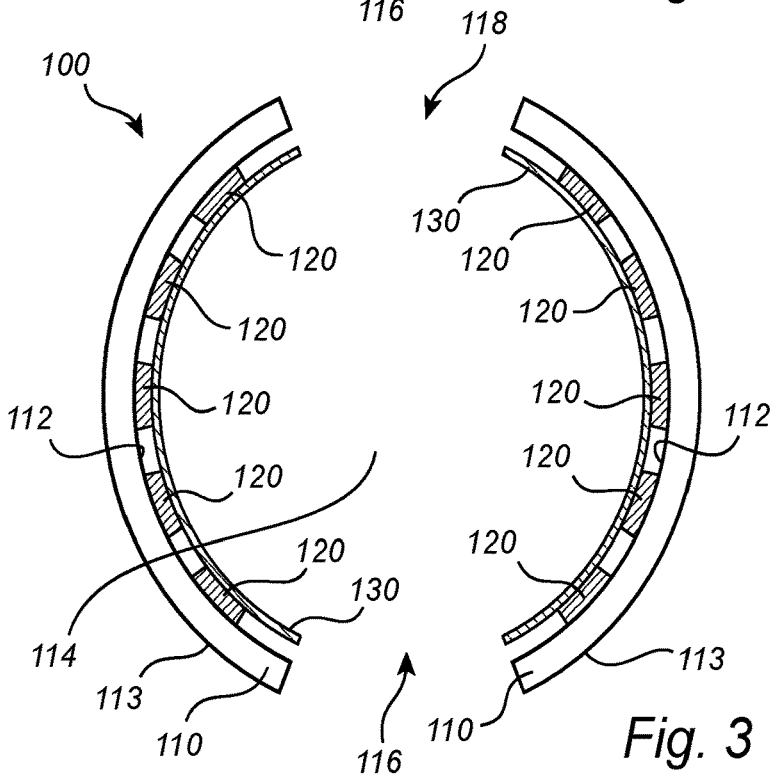

With reference to FIGS. 2 and 3, the lighting module 100 may comprise a carrier 130 to which the plurality of light-emitting elements 120 are coupled or connected, or which is configured to support the plurality of light-emitting elements 120. The carrier 130 may for example comprise PCB and/or a foil, and may be at least in part flexible (i.e. at least a portion or portions of the carrier 130 may be flexible). For example, the carrier 130 may include a flexible PCB and/or a flexible foil, facilitating or allowing for conforming of the shape of the carrier 120 to the shape of the elongated member 110.

As illustrated in FIG. 2, the carrier 120 may be coupled or connected to the inner surface 112 of the elongated member 110.

As illustrated in FIG. 3, the plurality of light-emitting elements 120 may be directly connected on the inner surface 112 of the elongated member 110. By way of the carrier 130 to which the plurality of light-emitting elements 120 are coupled, electrical connections to the plurality of light-emitting elements 120 may be realized or implemented. The plurality of light-emitting elements 120 may for example be glued to the inner surface 112 of the elongated member 110 using transparent glue, e.g. silicone glue.

The carrier 130 may be configured to transfer heat, generated by the plurality of light-emitting elements 120 when in use, away from the plurality of light-emitting elements 120. Thus the carrier 130 may be configured so as to exhibit a heat transferring capacity and/or functionality.

Figure 4:
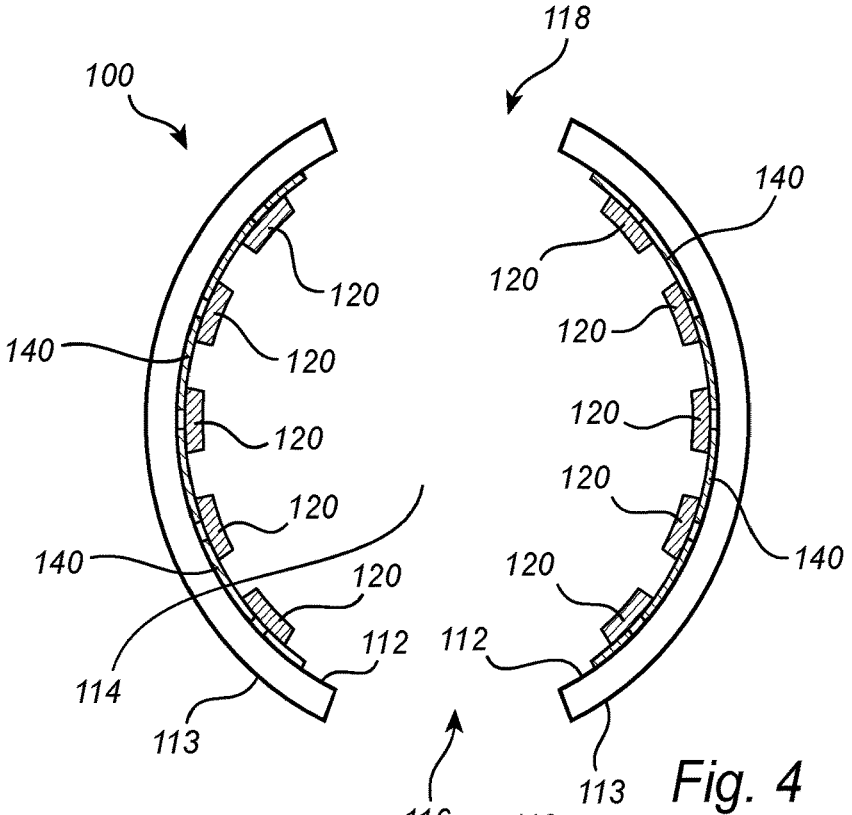

With reference to FIG. 4, the inner surface 112 of the elongated member 110 may comprise a plurality of electrically conductive tracks 140 to which the plurality of light-emitting elements 120 are electrically connected. Only some of the electrically conductive tracks 140 are indicated by a reference numeral in FIG. 4. The electrically conductive tracks 140 may for example be applied onto the inner surface 112 of the elongated member 110 by means of printing. The electrically conductive tracks 140 may in principle comprise any appropriate electrically conductive material as known in the art.

Figure 5:
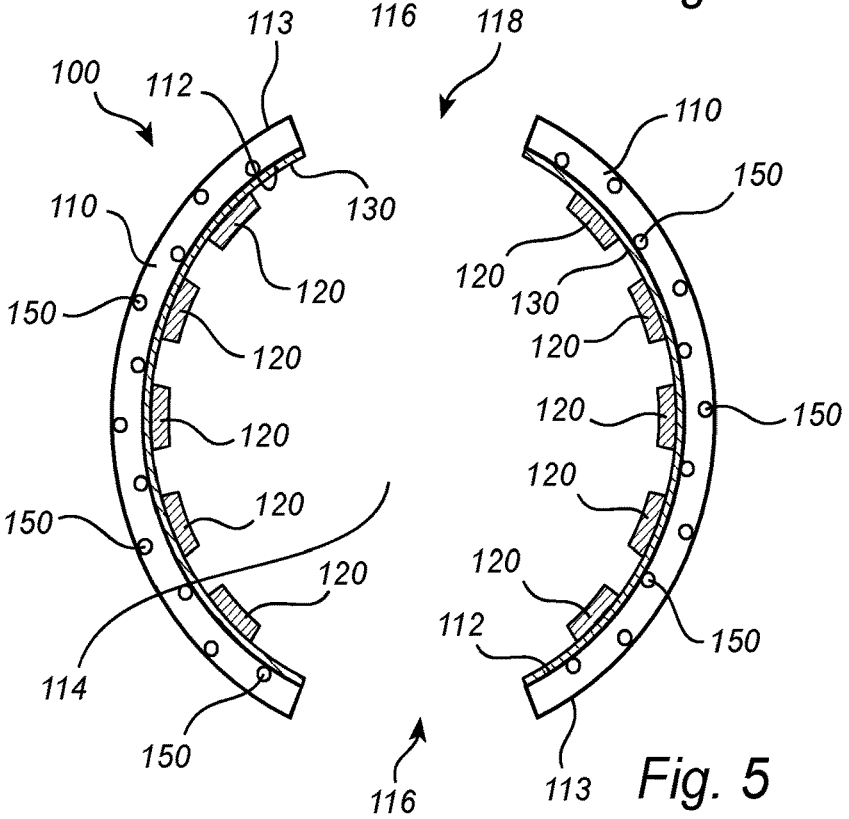

With reference to FIG. 5, the elongated member 110 may comprise light-scattering elements 150 configured to scatter light incident on the respective light-scattering elements 150. Only some of the light-scattering elements 150 are indicated by a reference numeral in FIG. 5. For example, in accordance with the embodiment of the present invention illustrated in FIG. 5, the light-scattering elements 150 may comprise light-scattering particles embedded or integrated in the elongated member 110. In alternative or in addition, the light-scattering elements 150 may comprise a layer or coating of material such as $Al_2O_3$, $BaSO_4$ and/or $TiO_2$ on the inner surface 112 and/or the outer surface 113 of the elongated member 110. According to another example, the inner surface 112 and/or the outer surface 113 of the elongated member 110 may have a rough structure.

Figure 6:
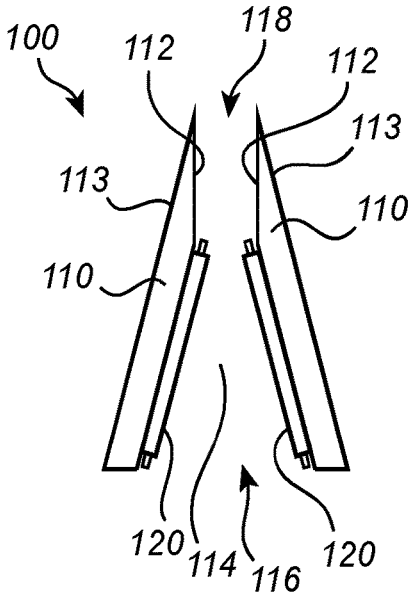
Figure 7:
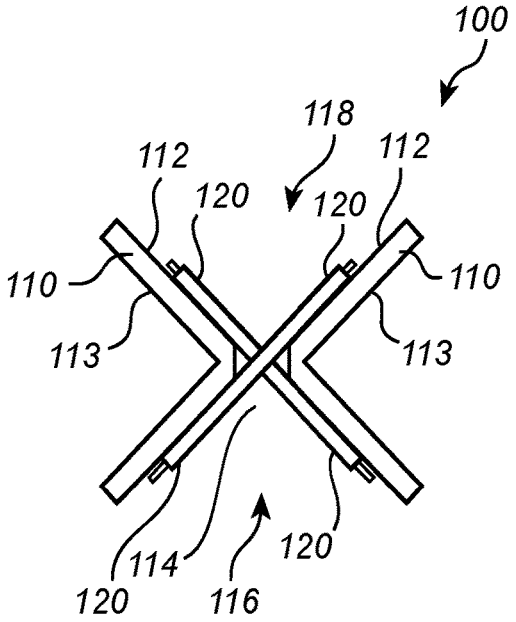

FIGS. 6 and 7 illustrate further examples of shapes that the elongated member 110 may have.

As illustrated in FIG. 6, the elongated member 110 may be conical.

As illustrated in FIG. 7, the elongated member 110 may have a shape similar to the shape of a diabolo, e.g., an hourglass-like, double-cone shape, or a shape similar to an elliptic cone.

Figure 8:
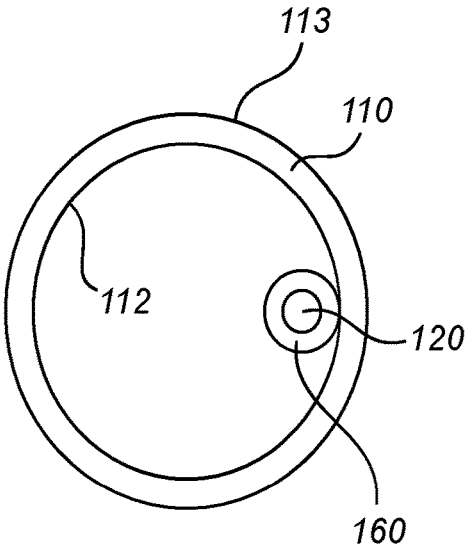
FIGS. 8 to 10 are schematic cross-sectional top views of lighting modules according to embodiments of the present invention.
Figure 9:
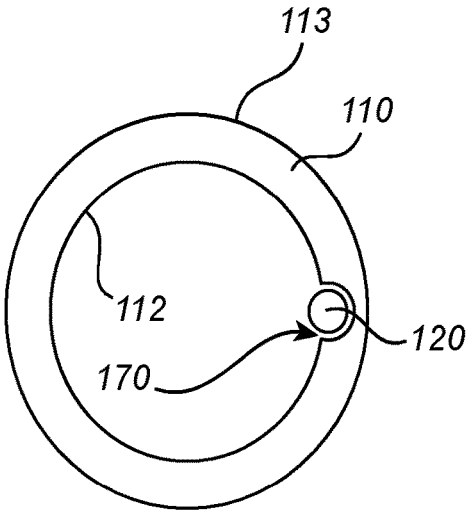
Figure 10:
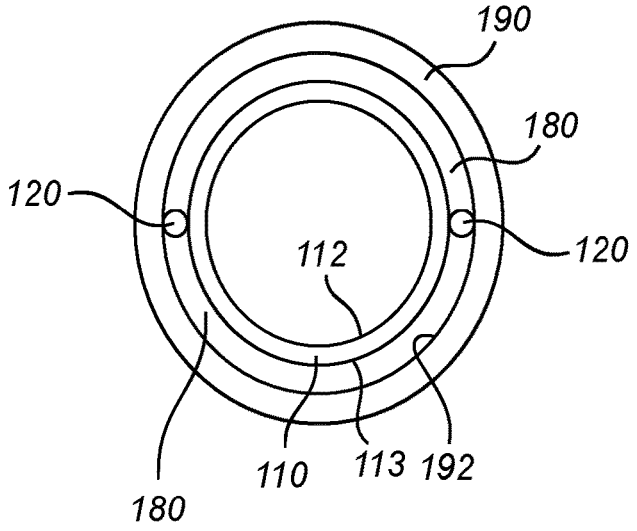

FIGS. 8 to 10 are schematic cross-sectional top views of lighting modules 100 according to embodiments of the present invention.

According to the embodiment of the present invention illustrated in FIG. 8, all or some of the plurality of light-emitting elements 120 may at least in part be enclosed in an enclosure 160. The enclosure 160 may for example comprise a transparent or translucent, or in part transparent and in part translucent, tube. As illustrated in FIG. 8, the enclosure 160 may be connected to the inner side surface 112 of the elongated member 110, e.g. by means of using transparent silicon glue or some other appropriate coupling means as known in the art. According to an example, the enclosure 160 may comprise a light-transmissive tubular structure configured so as to accommodate at least one string of light-emitting elements, e.g. in the form of a so called LED strip and/or a LED filament.

According to the embodiment of the present invention illustrated in FIG. 9, the inner surface 112 of the elongated member 110 may comprise a recess, or cavity, 170. At least one of the light-emitting elements 120 may be arranged in the recess 170. The light-emitting elements 120 may be connected to the inner side surface 112 of the elongated member 110 within the recess 170 for example by means of using transparent silicon glue or some other appropriate coupling means as known in the art.

According to the embodiment of the present invention illustrated in FIG. 10, the light-transmissive, elongated member 110 is arranged within an additional, hollow light-transmissive elongated member 190 such that there is a space 180 between an inner surface 192 of the additional elongated member 190 and an outer surface 113 of the other elongated member 110, wherein the plurality of light-emitting elements 120 are arranged in the space 10 between the elongated members 110, 190.

Thus, the elongated member 110 may constitute a first, inner light-transmissive, elongated member and the elongated member 190 may constitute a second, outer light-transmissive, elongated member. The second light-transmissive, elongated member 190 is hollow and the first light-transmissive, elongated member 110 is arranged within the second light-transmissive, elongated member 190, such that there is a space 180 between the first, inner light-transmissive, elongated member 110 and the second, outer light-transmissive, elongated member 190, in which space 180 the plurality of light-emitting elements 120 may be arranged. For example, the plurality of light-emitting elements 120, e.g. in the form of a so called LED strip and/or a LED filament, may be 'integrated' between the two light-transmissive, elongated members 110, 190.

In conclusion, a lighting module is disclosed, comprising a light-transmissive, elongated member with a light-guiding region within the elongated member. The elongated member may be configured such that the light-guiding region permits passage of fluid through the elongated member, possibly between a first end and a second end thereof. A plurality of light-emitting elements are coupled to the elongated member within the elongated member and such that the optical axis of at least one light-emitting element is non-perpendicular with respect to a longitudinal axis of the lighting module.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

a lighting module comprising:

a light-transmissive, elongated member having an inner surface which at least in part defines a light-guiding region within the elongated member; and a plurality of light-emitting elements, each light-emitting element being configured to emit light, wherein the light-emitting elements are coupled to the inner surface of the elongated member such that an optical axis of at least one of the light-emitting element is non-perpendicular with respect to a longitudinal axis of the lighting module;

wherein the longitudinal axis of the lighting module is an axis of rotational symmetry of the lighting module such that the elongated member has a circular cross-sectional shape perpendicular to the longitudinal axis;

wherein the elongated member has at least a first end and a second end that are aligned along the longitudinal axis and are both open to permit passage of fluid therethrough and into and out of the first end and the second end, respectively;

the lighting device further comprising a light-transmissive envelope enclosing the lighting module; and wherein the light-transmissive envelope defines a fluidly sealed and enclosed space within which the lighting module is arranged.

2. A lighting device according to claim 1, wherein at least a portion of at least the inner surface of the elongated member is non-parallel with respect to the longitudinal axis, and wherein at least some light-emitting elements are coupled to or supported by the at least a portion of the inner surface.

3. A lighting device according to claim 1, wherein the inner surface comprises at least one recess, and wherein at least one of the light-emitting elements is arranged in the recess.

4. A lighting device according to claim 1, wherein at least some of the plurality of light-emitting elements are at least in part enclosed in an enclosure, and wherein the enclosure is connected to the inner surface of the elongated member.

5. A lighting device according to claim 1, wherein the inner surface of the elongated member comprises a plurality of electrically conductive tracks to which the plurality of light-emitting elements are electrically connected.

6. A lighting device according to claim 1, wherein the plurality of light-emitting elements are configured as at least one string of light-emitting elements.

7. A lighting device according to claim 1, wherein at least two light-emitting elements are spaced from each other with respect to the longitudinal axis of the lighting module.

8. A lighting device according to claim 1, wherein the light-emitting elements are coupled to the inner surface.

9. A lighting device according to claim 1, wherein the elongated member comprises at least one light-scattering element configured to scatter light incident thereon.

10. A lighting device according to claim 1, further comprising a carrier to which the plurality of light-emitting elements are coupled.

11. A lighting device according to claim 1, wherein the fluidly sealed and enclosed space comprising a thermally conductive fluid.

12. A lighting device according to claim 11, wherein the thermally conductive fluid comprises a gas including helium and/or hydrogen.

13. A lighting device according to claim 1, wherein the longitudinal axis is also an axis of rotational symmetry of the lighting device.

14. A lighting device comprising:

a lighting module comprising:

a light-transmissive, elongated member having an inner surface which at least in part defines a light-guiding region within the elongated member; and a plurality of light-emitting elements, each light-emitting element being configured to emit light, wherein the light-emitting elements are coupled to the inner surface of the elongated member such that an optical axis of at least one of the light-emitting element is non-perpendicular with respect to a longitudinal axis of the lighting module;

wherein the elongated member has at least a first end and a second end, the elongated member being configured such that the light-guiding region permits passage of fluid therethrough and into and out of the first end and the second end, respectively;

the lighting device further comprising a light-transmissive envelope enclosing the lighting module; and wherein the light-transmissive envelope defines a fluidly sealed and enclosed space within which the lighting module is arranged and the light-transmissive, elongated member is arranged within an additional, hollow light-transmissive elongated member such that there is a space between an inner surface of the additional elongated member and an outer surface of the other elongated member, wherein the plurality of light-emitting elements are arranged in the space between the elongated members.

* * * * *